US010524531B2

(12) United States Patent
Roberts et al.

(10) Patent No.: US 10,524,531 B2
(45) Date of Patent: Jan. 7, 2020

(54) INNER SOLE FOR A SHOE

(71) Applicant: IMPACT TECH LABS LIMITED, Twickenham (GB)

(72) Inventors: Jason Lloyd Roberts, St Margarets (GB); Wilhelm Marschall, London (GB); Haim Geva, London (GB); Kemal Dervish, Welwyn Garden City (GB); Giles Tongue, Twickenham (GB)

(73) Assignee: NURVV LIMITED, Twickenham (GB)

( * ) Notice: Subject to any disclaimer, the term of this patent is extended or adjusted under 35 U.S.C. 154(b) by 0 days.

(21) Appl. No.: 15/824,150

(22) Filed: Nov. 28, 2017

(65) Prior Publication Data

US 2019/0053566 A1 Feb. 21, 2019

Related U.S. Application Data

(60) Provisional application No. 62/546,655, filed on Aug. 17, 2017.

(51) Int. Cl.
*A43B 3/00* (2006.01)
*A43B 17/00* (2006.01)

(52) U.S. Cl.
CPC ..... *A43B 3/0005* (2013.01); *A43B 17/00* (2013.01)

(58) Field of Classification Search
CPC ..... A43B 3/0005
See application file for complete search history.

(56) References Cited

U.S. PATENT DOCUMENTS

2010/0090477 A1* 4/2010 Keating ..... A43B 3/0005 290/1 R
2011/0260857 A1* 10/2011 Hamill ..... A43B 17/00 340/539.13
2014/0165427 A1* 6/2014 Molyneux ..... A43B 13/203 36/102
2014/0260677 A1* 9/2014 Dojan ..... G01L 1/2206 73/862.045
2016/0313174 A1* 10/2016 Lightstone ..... G01G 19/50
2016/0335913 A1* 11/2016 Grant ..... G01S 19/49
2016/0349076 A1* 12/2016 Campos Gallo ..... A43B 3/0005
2018/0018900 A1* 1/2018 Oleson ..... G09B 19/0038
2018/0160975 A1* 6/2018 London ..... A61B 5/1118
2018/0333080 A1* 11/2018 Malawey ..... A61B 5/1038
2018/0344210 A1* 12/2018 Pestl ..... A61B 5/103

* cited by examiner

*Primary Examiner* — Ted Kavanaugh
(74) *Attorney, Agent, or Firm* — Stites & Harbison, PLLC; Jeffrey A. Haeberlin

(57) ABSTRACT

Inner soles including a pressure sensor, transmitter, a global positioning tracking device, an accelerometer, a power source and control circuit are provided, as well as systems including the inner soles and methods of use.

12 Claims, 8 Drawing Sheets

INNER SOLE FOR A SHOE

CROSS-REFERENCE TO RELATED APPLICATIONS

This application claims the benefit of U.S. Provisional Application No. 62/546,655, filed Aug. 17, 2017, which is hereby incorporated by reference.

BACKGROUND OF THE INVENTION

1. Field of the Invention

The presently-disclosed subject matter relates to an inner sole for a shoe, and methods of using the inner sole to detect, monitor, and transmit information regarding use of the inner sole.

2. Description of the Related Art

Tracker devices such as the Nike+™ are known which are inserted in a shoe and which provide a limited amount of information on the distance and pace of a run or walk.

At present, if a user wishes to obtain information on their gait, foot strike and/or player loading as a guidance for buying a new pair of shoes or for adjusting their movements and/or stride, they typically have to go to a sportswear store and run on a treadmill whereupon a camera will produce an image which can be used to analyze their gait.

BRIEF SUMMARY OF THE INVENTION

The present invention aims to improve shoe tracking systems.

The presently-disclosed subject matter meets some or all of the above-identified needs, as will become evident to those of ordinary skill in the art after a study of information provided in this document.

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. To avoid excessive repetition, this Summary does not list or suggest all possible combinations of such features.

According to a first aspect of the present invention, there is provided an inner sole for a shoe, the inner sole comprising a main body made at least in part of a compressible material and a number of components embedded within the main body, the components comprising: a pressure sensor; a transmitter; a global positioning tracking device; an accelerometer; a power source connected to one or more of the pressure sensor, transmitter, global positioning tracking device and accelerometer; and a control circuit configured to receive data from the pressure sensor, global positioning tracking device and accelerometer transmit it via the transmitter to a remote location.

The present invention can include a pressure sensor, a global positioning tracking device, and an accelerometer, all of which gather data concerning the manner in which a user is running or walking. This information is then collected and transmitted to a remote location to enable information to be obtained which is hitherto unavailable in the prior art.

In some embodiments, the inner sole may further comprise a subscriber identity module (SIM) card. The SIM card may be removable, or preferably may be an integrated e-SIM. The transmitter may connect the inner sole to a local device with a SIM or e-SIM which has cellular communication capabilities.

The pressure sensor may comprise first and second pressure sensing areas, wherein the first pressure sensing area is positioned in a heel region of the main body of the inner sole, and the second pressure sensing area is positioned in a forefront region of the main body of the inner sole.

Alternatively, the inner sole may further comprise a second pressure sensor, wherein the first pressure sensor is positioned in the heel region of the main body and the second pressure sensor is positioned in a forefront region of the main body.

The inner sole may be provided as a removable inner sole for a shoe. However, it can also be directly integrated into a finished shoe.

The inner sole may preferably also comprise an altimeter connected to the control circuit.

The inner sole may preferably also comprise an electrocardiographic sensor connected to the control circuit.

The power source may be any suitable source such as a high capacity capacitor. However, it is preferably a battery. This may be replaceable, removable for recharging or rechargeable in situ. When the battery is rechargeable in situ, the inner sole preferably comprises a power inlet port.

The present invention also extends to a second aspect which is a system comprising an inner sole according to a first aspect of the present invention together with a remote device to receive information from the transmitter of the inner sole, the remote device having means to process and manipulate the received data to display the manipulated information. The remote device can be provided with an appropriate operating system and compatible software, most commonly in the form of an app, to decode and display the received data. The received data may be displayed on the remote device itself, on other third party devices, and/or on a social media platform. The app is preferably customizable to allow the user to select which information is displayed and the manner in which it is displayed. The inner sole may also be provided with means to process and manipulate information before it is sent from the transmitter of the inner sole. In some instances, the processing and manipulating of information can include determining from the information received from the pressure sensor how a user's weight is distributed as their foot lands on the ground and/or how much pressure is put on the user's feet when moving from side to side. When the means to process and manipulate information is provided in the inner sole, this allows the amount of information and the frequency of communication to a remote location to be reduced.

The remote device may be the user's personal device. Alternatively, or in addition, data may be sent to a remote device which is operated by a second user. As an example, this data may include the location of the inner soles so that the second user to track the progress of the first user. This location data may be overlaid with a map of the first user's route, such as in a race condition.

The system may further comprise a database of data relating to a number of brands and/or types of footwear (including brands and/or types of inner soles), the data concerning the ability of the footwear to support the sole of the user; and means for comparing information from the pressure sensor with the database and providing an indication to the user of a preferred brand and/or type of footwear based on this comparison. This indication may allow the user to place an order for the particular brand and/or type of footwear. Using known techniques such as affiliate marketing, the user can then be directed to a point of purchase, such as an online retailer.

The data concerning the ability of the footwear to support the sole of the user may be stored in a further database, along with an identifier of the worn brand and/or type of footwear for use by manufacturers to determine how to make improvements to newer versions of the brand and/or type of footwear.

This forms a third aspect of the present invention which is a method of determining optimum footwear use for a user, the method comprising using a system according to the second aspect of the present invention and comprising the steps of: determining from the information received from the pressure sensor how a user's weight is distributed as their foot lands on the ground and/or how much pressure they are putting on their feet when moving from side to side; transmitting this information to the remote device, the remote device having access to data for a number of brands and/or types of footwear, the data concerning the ability of a brand and/or type of footwear to support the sole of a user; and comparing the distribution of the sensed forces against the data of the stored brands and/or types of footwear, and recommending a preferred brand and/or type of footwear based on this comparison. Using known techniques such as affiliate marketing, the user can then be directed to a point of purchase, such as an online retailer.

At present, if a user wishes to obtain information on their gait, foot strike and/or player loading as a guidance for buying a new pair of shoes, they typically have to go to a sportswear store and run on a treadmill whereupon a camera will produce an image which can be used analyses their gait.

With the present invention, information on the nature of their gait, foot strike and/or player loading can be obtained in real time during normal use. The indication of preferred footwear may, for example, be a recommendation to obtain a particular shoe or a range of shoes. In addition, the information regarding the nature of the user's gait, foot strike and/or player loading may be used in conjunction with known biomechanics, sports science knowledge and expertise to recommend an ideal running style. In addition or alternatively, event specific recommendations such as running speed, power output and cadence may be provided for a particular event in which the user is taking part. The recommendation may also include condition related advice, such as when to take a rest or hydrate.

According to a fourth aspect of the present invention, there is provided a method of determining the length of time a person is off the ground, the method comprising providing the person with at least one inner sole according to a first aspect of the present invention, using a combination of accelerometer to determine a sharp acceleration and the pressure sensor to determine a simultaneous sharp drop in the sensed pressure indicating a take-off time signifying that the person has left contact with the ground; using a combination of the accelerometer to determine a sharp deceleration and the pressure sensor to determine a simultaneous sharp increase in the sensed pressure indicating a landing time signifying the person has landed; and measuring the time between the take-off and landing conditions to determine the time for which a user had left the ground. Data from the altimeter may be used in connection with, or as an alternative to, the above methods for determining the take-off and landing conditions.

This allows the inner sole to measure the "hang time", namely the time for which a wearer of the shoe is off the ground. This can provide important statistical information for sports coaches, and can also provide interesting information for spectators.

BRIEF DESCRIPTION OF THE DRAWINGS

The invention will now be described in detail, by way of example only, with reference to the accompanying drawings in which.

DETAILED DESCRIPTION OF EXEMPLARY EMBODIMENTS OF THE INVENTION

An embodiment of the present invention is shown as the inner sole 100 of FIGS. 1 to 7.

Figure 1:
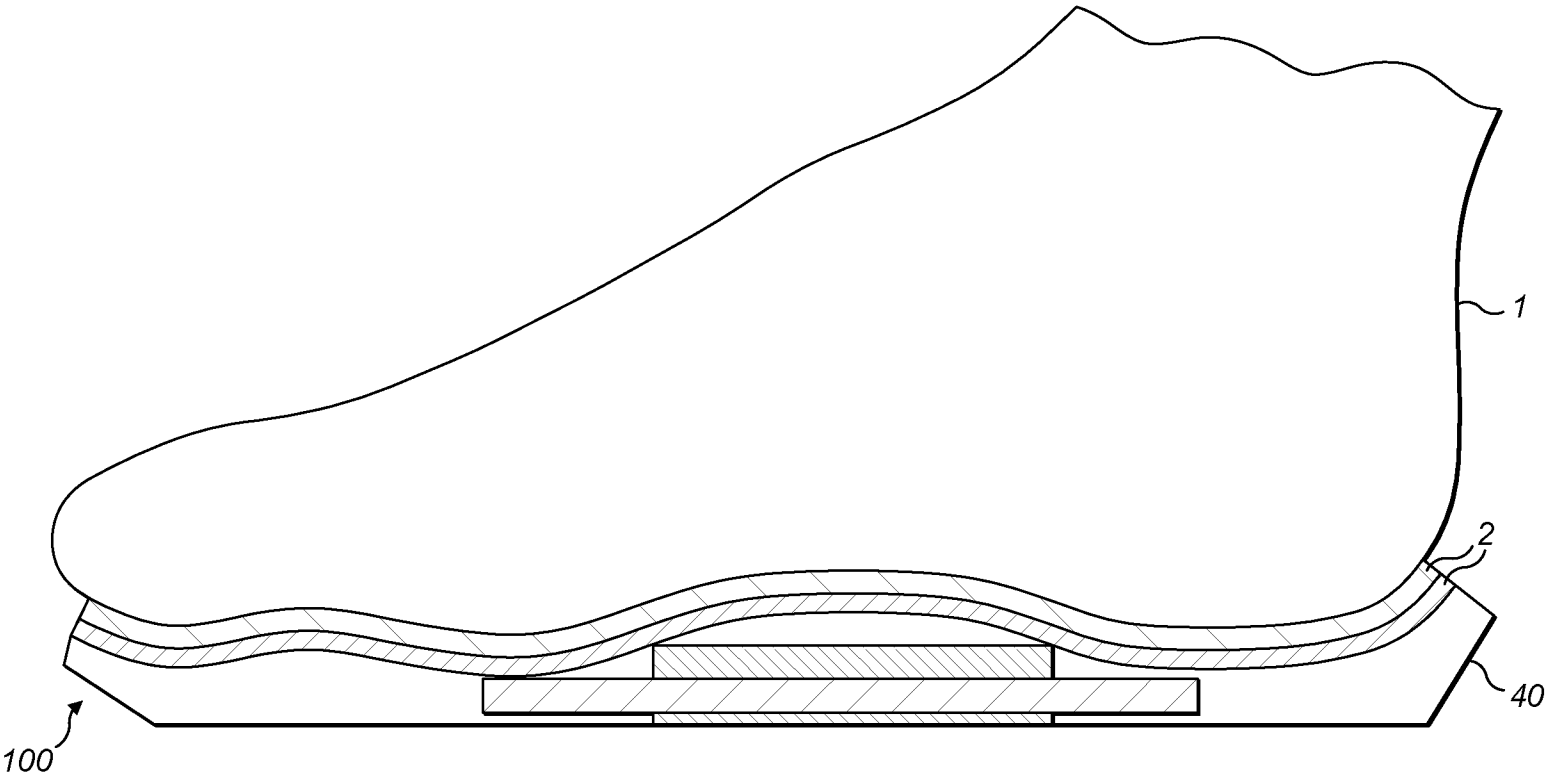
FIG. 1 is a side cutaway view of an inner sole according to one embodiment of the present invention.

The inner sole 100 is formed by a hardware layer 40 and a multi-layer sensor layer 2. As shown in FIG. 1, the inner sole 100 is substantially contoured to match a user's foot 1.

The sensor layer 2 will now be described in more detail with respect to FIGS. 2 to 5. FIG. 3 shows the top layer 10 of the multi-layer sensor layer 2 that contacts with the users foot 1. The Figure is viewed looking upwards from FIG. 1, towards the foot 1 of the user. The top sensor layer 10 is substantially made from a material which is suitably absorbing and dissipating such as high impact engineering polymers (such as polycarbonate or nylon), glass or carbon fiber composites, bi-axial oriented films or any other material which provides high flexural strength, high puncture resistance and flexibility.

This material provides the contact point for the user's foot 1. On the underside of the layer 10, away from the user's foot 1, first and second sensing arrangements 11, 15 are provided. The first sensing arrangement 11 is located towards the front of the layer 10 and comprises a sensing area 12 positioned to sense the force applied by the user's forefoot. In electrical connection with the sensing area 12 is a tracking section 13 which is in turn in electrical connection with a contact pad 14. The second sensing arrangement 15 is located toward the back of the layer 10 and comprises a sensing area 16 positioned to sense the force applied by the user's heel. In electrical connection with the sensing area 16 is a tracking section 17 which is in turn in electrical connection with a contact pad 18.

Figure 3:
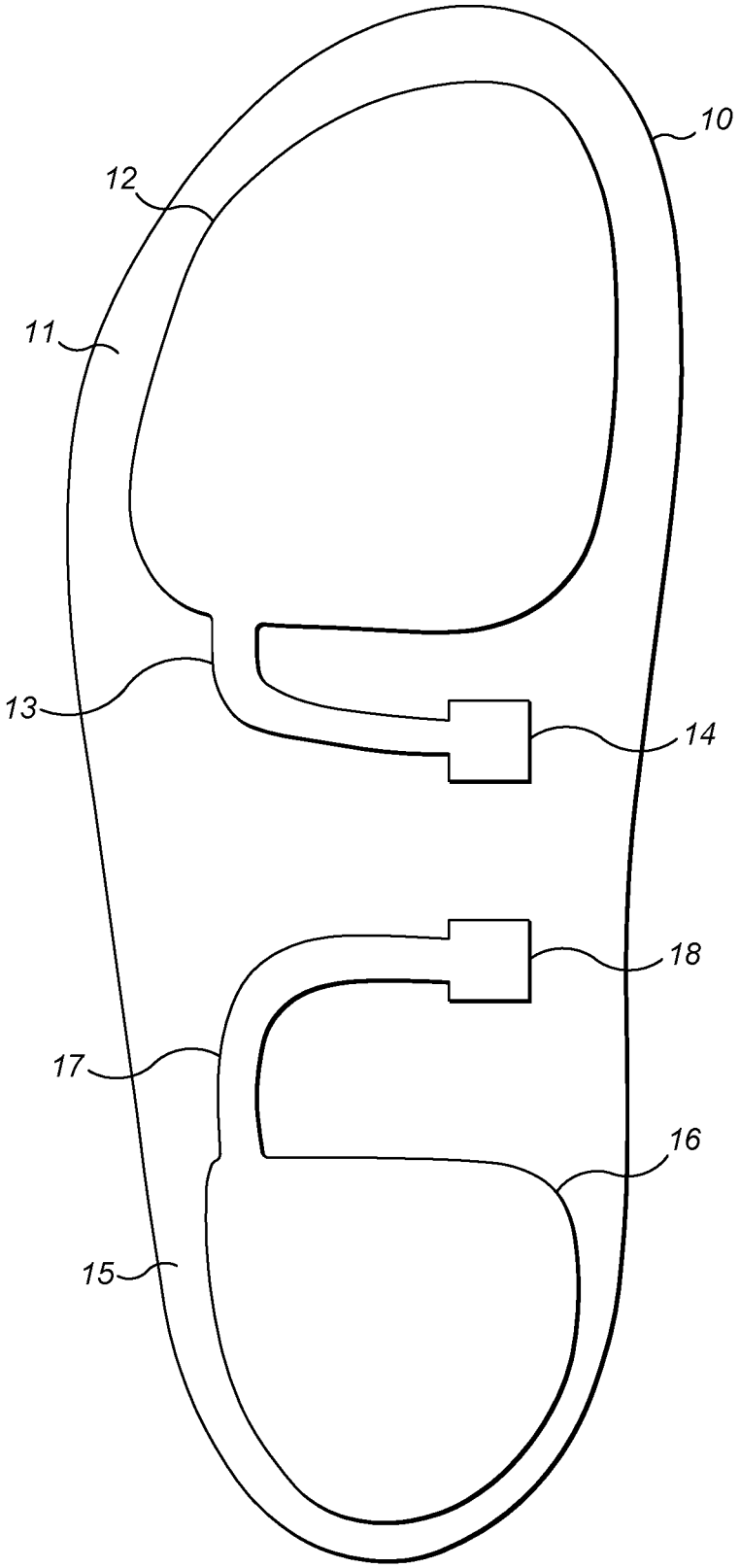
FIG. 3 is a bottom view of a top layer of an inner sole according to one embodiment of the present invention.
Figure 4:
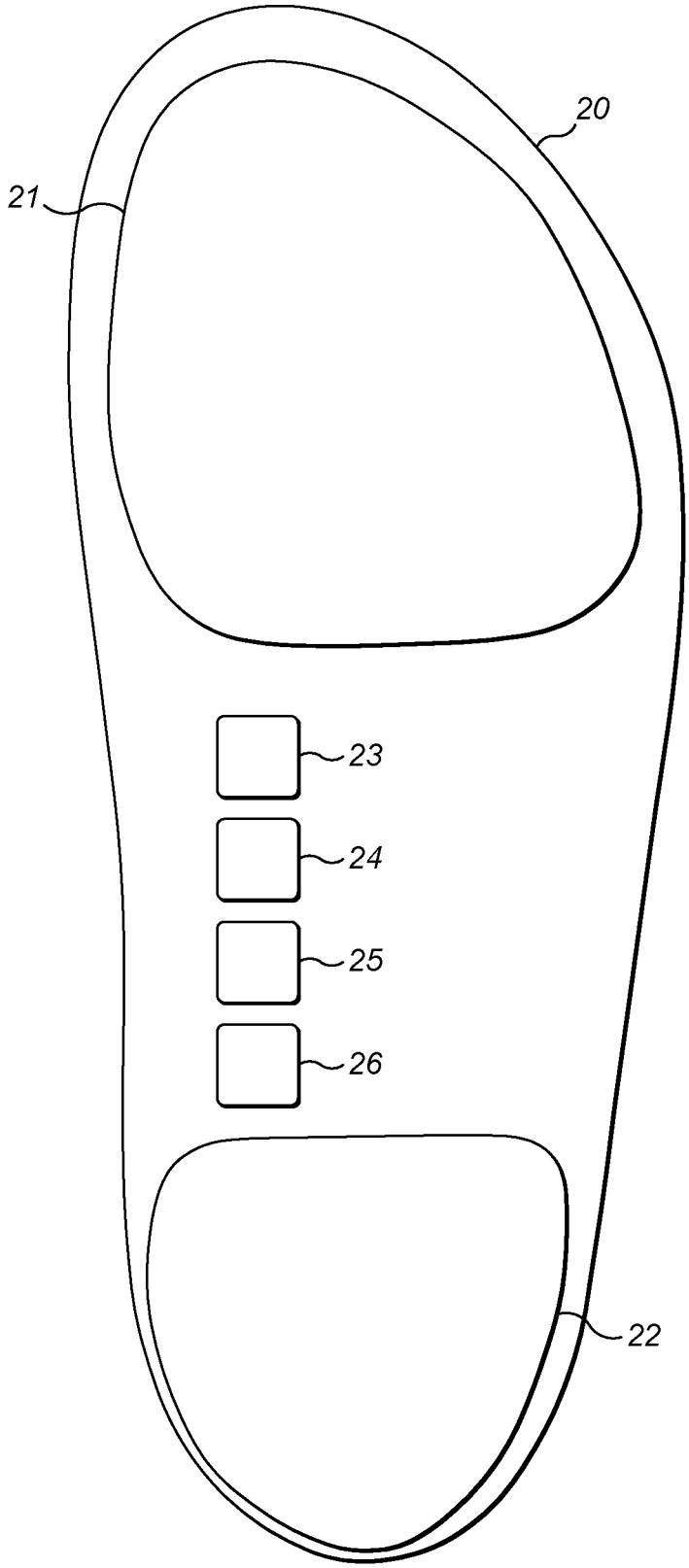
FIG. 4 is a top view of a middle layer of an inner sole according to one embodiment of the present invention.

The middle layer 20 of the multi-layer sensor layer 2 is shown in FIG. 4. This view is looking down from the user's foot 1 in FIG. 1 (the opposite direction to the view of FIG. 3). The middle layer 20 is a conductive layer for conducting electricity. The layer is typically formed from a polymeric film which has been impregnated with carbon black ink to form a number of conductive regions. These regions comprise frontal and rear sensor conductive areas 21, 22 which are in electrical contact with the first and second sensing areas 12, 16 of the first layer 10. Conductive pads 23, 24, 25 and 26 are also provided. These conductive pads are electrically isolated from each other, and from the frontal and rear sensor conductive areas 21, 22. The conductive pads 23 and 25 are in electrical contact with the first and second contact pads 14, 18 of the first layer 10.

Figure 5:
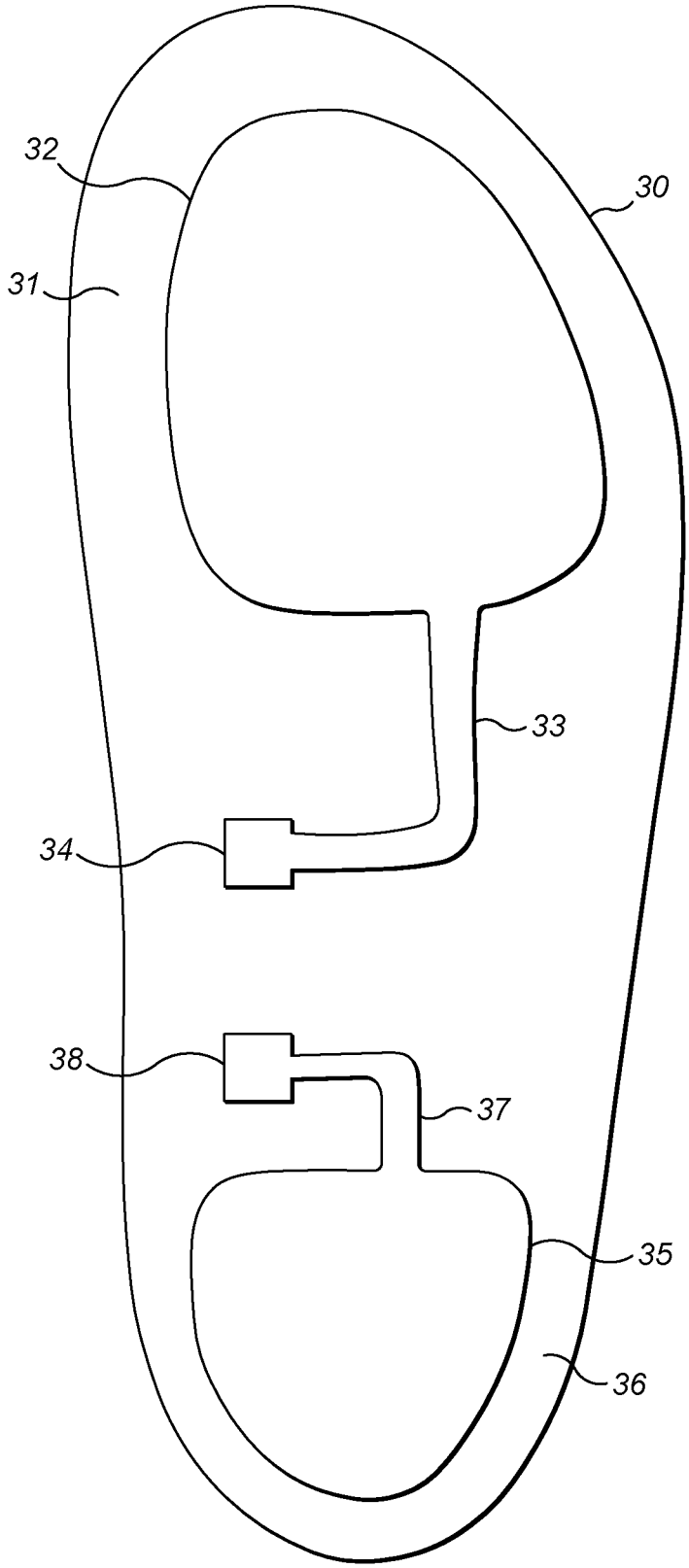
FIG. 5 is a top view of a further middle layer of an inner sole according to one embodiment of the present invention.

The bottom layer 30 of the multi-layer sensor layer 2 is shown in FIG. 5. The layer is made of a suitable cushioning material such as foamed elastomers, thermoplastic elastomers, foamed thermoplastic elastomers or any suitable compliant material. On the topside of the layer 30, toward from the user's foot 1, first and second sensing arrangements 31, 36 are provided. The first sensing arrangement 31 is located towards the front of the layer 30 and comprises a sensing area 32 positioned to sense the force applied by the user's forefoot. In electrical connection with the sensing area 32 is a tracking section 33 which is in turn in electrical connection with a contact pad 34. The second sensing arrangement 36 is located toward the back of the layer 30 and comprises a sensing area 35 positioned to sense the force applied by the user's heel. In electrical connection with the sensing area 35 is a tracking section 37 which is in turn in electrical connection with a contact pad 38.

The three layers 10, 20, 30 of the multi-layer sensor layer 2 may be formed together in a multi-stage forming process. Alternatively, the layers 10, 20, 30 may be adhesively bonded to one another.

Figure 6:
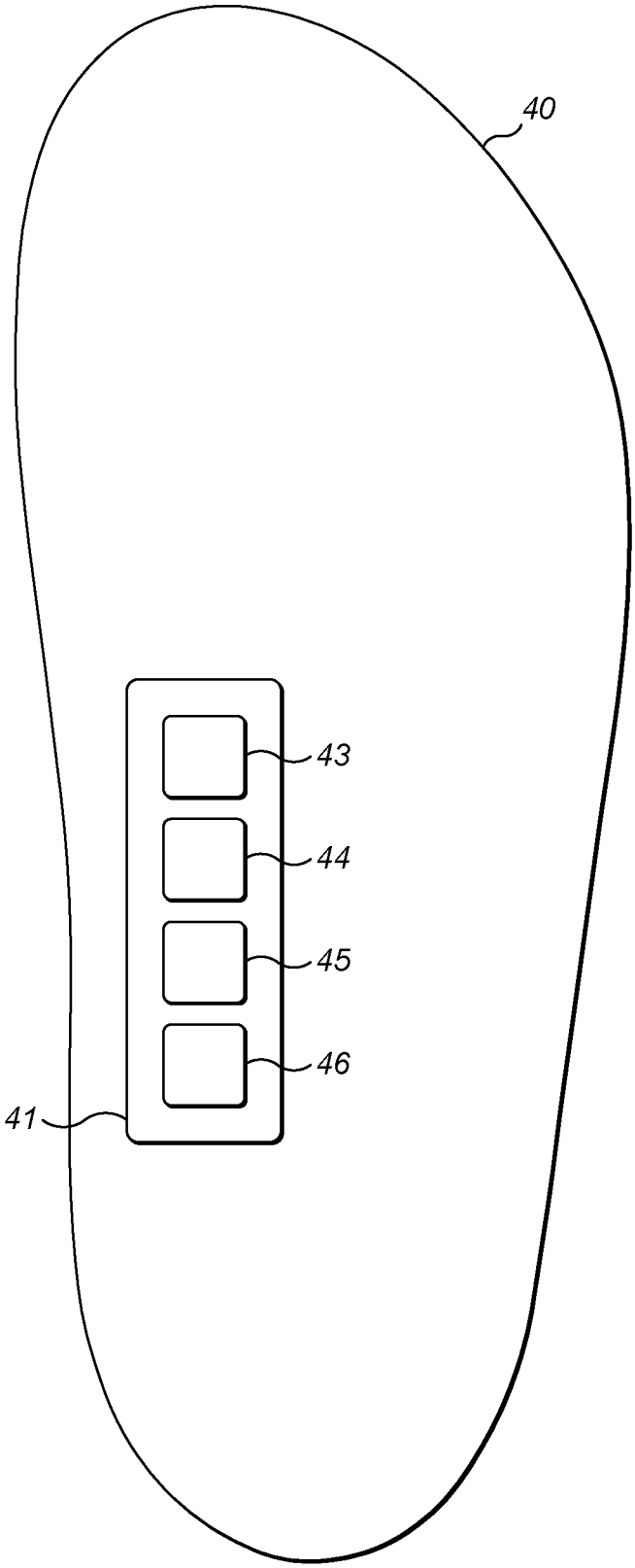
FIG. 6 is a top view of a bottom layer of an inner sole according to one embodiment of the present invention.
Figure 7:
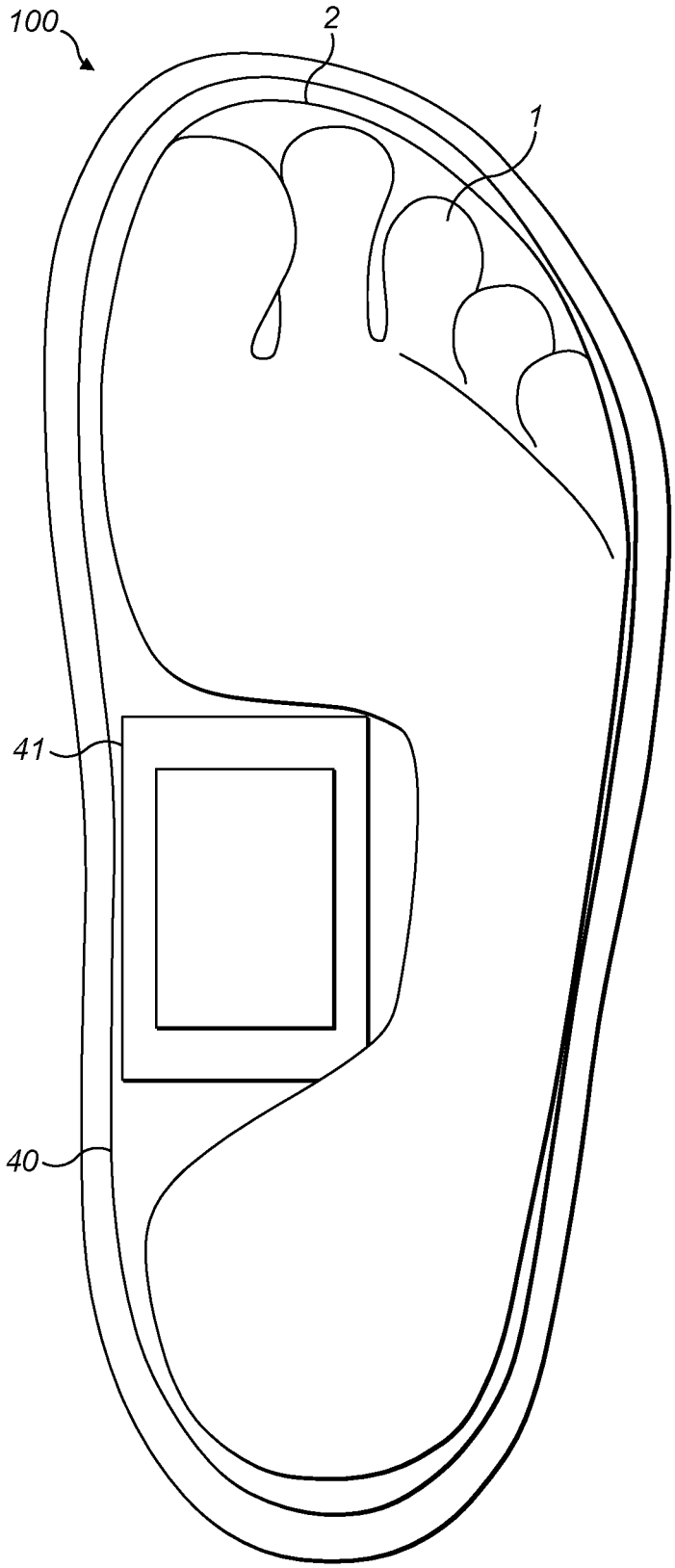
FIG. 7 is a bottom partial cutaway view of an inner sole according to one embodiment of the present invention.

The hardware layer 40 is depicted in FIG. 6. This layer 40 is made of a structural material in order to support the sensors and to embed and protect any hardware needed for operation of the insert. The hardware layer 40 comprises a PCB assembly 41. This PCB assembly comprises any of the further sensors associated with the inner sole 100. In particular, the PCB may comprise a micro-processor, motion sensor (such an accelerometer and/or gyroscope), a satellite navigation receiver/antenna, a wireless communication module (such as Bluetooth and/or cellular communication via an integrated subscriber identity module (SIM) card (e-SIM)) and a power source (such as a battery module) connected to the above components. In preferred embodiments, the battery module is a lithium ceramic battery. The hardware layer 40 is also provided with a number of hardware contacts 43, 44, 45, 46. These contacts are arranged to be in electrical contact with the conductive areas 23, 24, 25, 26 of the middle layer 20 respectively in order to send and receive signals to the first and second sensing areas 11, 15, 31, 35 of each of the first and third layers 10, 30. These signals are processed by the micro-processor on the PCB in order to determine the force exerted by the user's foot 1 on each area. In order to ensure that the PCB does not affect the data gathered by the sensor regions, the PCB is located as shown in FIG. 7 in the arch region of the user's foot 1. This ensures that the sensing areas can extend over the whole of the contact areas at the forefoot and the heel.

Figure 2:
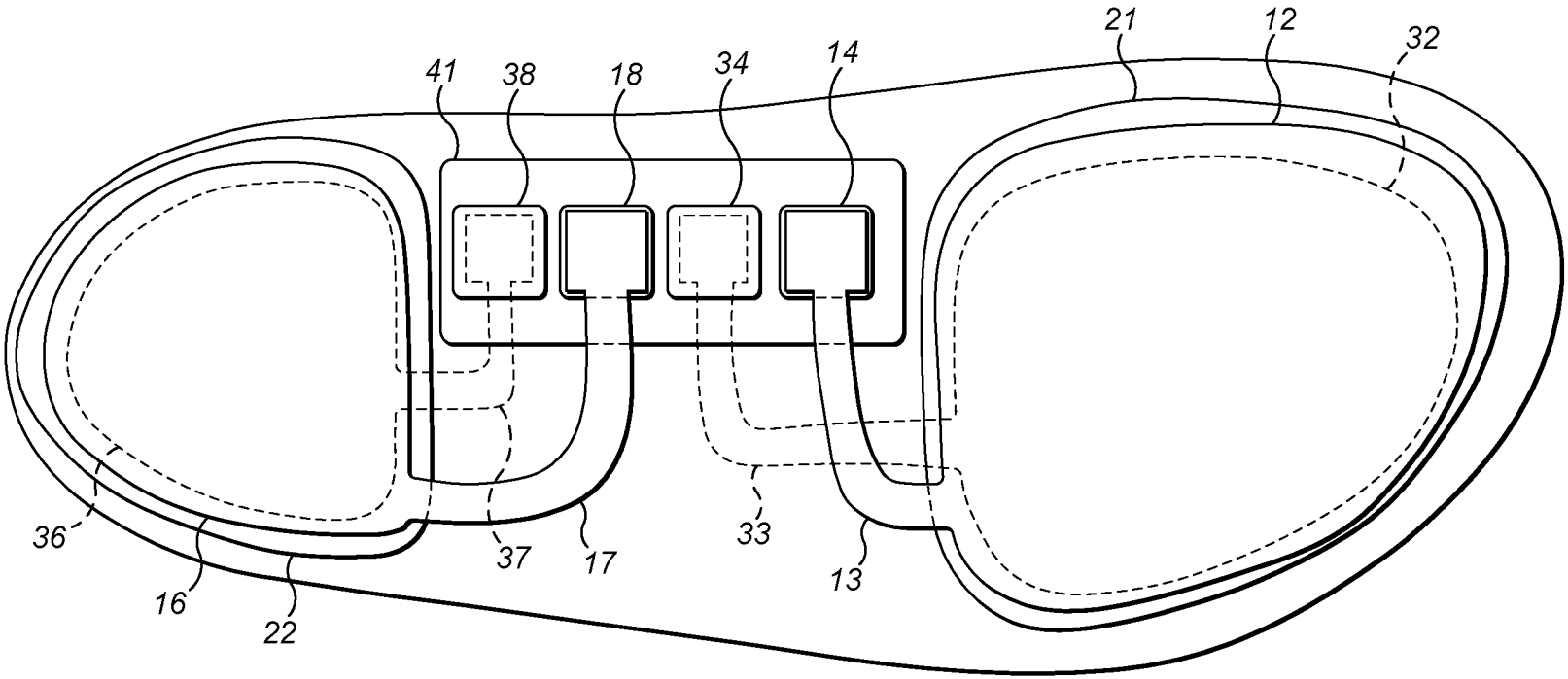
FIG. 2 is a composite schematic view of an inner sole according to one embodiment of the present invention.

A composite schematic showing the multi-layer sensor 2 joined together and attached to the hardware layer 40 is shown in FIG. 2. In this schematic, the material of the layers has not been included. The components of the bottom layer 30 have been indicated in dashed lines as they are located underneath and obstructed by the components of the first and second layers 10, 20.

Figure 8:
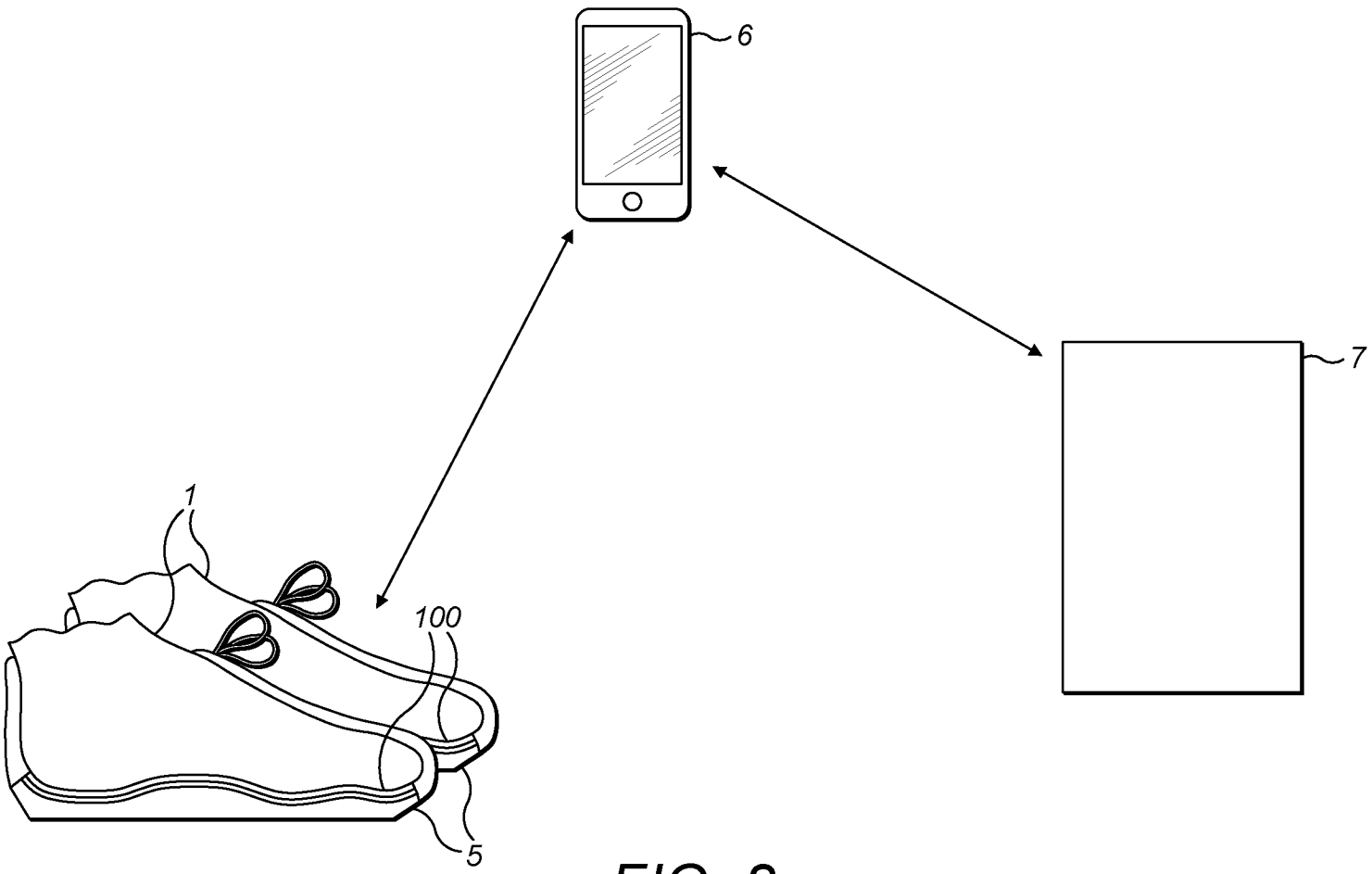
FIG. 8 is a schematic view of a system according to one embodiment of the present invention.

FIG. 8 shows a system according to the present invention. A user is wearing footwear 5, containing inner soles 100. Data is sent from the footwear 5 to a remote device 6, which in this embodiment is a smartphone. The remote device 6 is then in communication with an external server 7. The remote device 6 compares the information received from pressure sensor how a user's weight is distributed as their foot lands on the ground and/or how much pressure they are putting on their feet when moving from side to side with data stored on the external server 7 in order to provide an indication to the user of a preferred brand and/or type of footwear based on this comparison.

What is claimed is:

1. An inner sole for a shoe, the inner sole comprising a main body made at least in part of a compressible material and a number of components embedded within the main body, the components comprising:

a pressure sensor;

a transmitter;

a global positioning tracking device;

an accelerometer;

a power source connected to one or more of the pressure sensor, transmitter, global positioning tracking device and accelerometer; and a control circuit configured to receive data from the pressure sensor, global positioning tracking device and accelerometer transmit it via the transmitter to a remote location;

wherein the inner sole comprises a sensor layer and a hardware layer, wherein the hardware layer comprises at least the power source and the control circuit; and wherein the sensor layer comprises first and second sensing layers, with a conductive layer therebetween.

2. An inner sole according to claim 1, wherein the pressure sensor comprises first and second pressure sensing areas, the first pressure sensing area positioned in a heel region of the main body of the inner sole, and the second pressure sensing area positioned in a forefront region of the main body of the inner sole.

3. An inner sole according to claim 1, wherein the pressure sensor includes a first pressure sensor and a second pressure sensor, wherein the first pressure sensor is positioned in the heel region of the main body and the second pressure sensor is positioned in a forefront region of the main body.

4. An inner sole according to claim 1, further comprising a subscriber identity module (SIM) card.

5. A shoe comprising an inner sole according to claim 1.

6. An inner sole according to claim 1, further comprising an altimeter connected to the control circuit.

7. An inner sole according to claim 1, further comprising an electrocardiographic sensor connected to the control circuit.

8. An inner sole according to claim 1, wherein the power source is a rechargeable battery and the inner sole further comprises a power inlet port.

9. A system comprising an inner sole according to claim 1 together with a remote device to receive information from the transmitter of the inner sole, the remote device having means to manipulate the received data and to display the manipulated information.

10. A system according to claim 9 further comprising a database of data for a number of brands and/or types of footwear, the data concerning the ability of the footwear to support the sole of the user; and means for comparing the information from the pressure sensor with the database and providing an indication of a preferred brand and/or type of footwear based on this comparison.

11. A method of determining optimum footwear for a user, the method comprising:

using a system according to claim 9; and comprising the steps of:

determining from the information received from the pressure sensor how a user's weight is distributed as their foot lands on the ground and/or how much pressure is put on the user's feet when moving from side to side;

transmitting this information to the remote device, the remote device having access to data for a number of brands and/or types of footwear, the data concerning the ability of a brand and/or type of footwear to support the sole of a user; and comparing the distribution of the sensed forces against the data of the stored brands and/or types of footwear, and indicating a preferred brand and/or type of footwear based on this comparison.

12. A method of determining the length of time a person is off the ground, the method comprising:

providing the person with at least one inner sole according to claim 1, using a combination of accelerometer to determine a sharp acceleration and the pressure sensor to determine a simultaneous sharp drop in the sensed pressure thereby indicating a take-off time signifying that the person has left contact with the ground;

using a combination of the accelerometer to determine a sharp deceleration and the pressure sensor to determine a simultaneous sharp increase in the sensed pressure thereby indicating a landing time signifying the person has landed; and measuring the time between the take-off and landing conditions to determine the time for which a user had left the ground.

* * * * *